US008558749B2

(12) United States Patent
Meharry et al.

(10) Patent No.: US 8,558,749 B2
(45) Date of Patent: Oct. 15, 2013

(54) METHOD AND APPARATUS FOR ELIMINATION OF DUPLEXERS IN TRANSMIT/RECEIVE PHASED ARRAY ANTENNAS

(75) Inventors: David E. Meharry, Lexington, MA (US); Randall R. Lapierre, Manchester, NH (US); Bernard J. Schmanski, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 394 days.

(21) Appl. No.: 13/084,637

(22) Filed: Apr. 12, 2011

(65) Prior Publication Data

US 2011/0267998 A1 Nov. 3, 2011

Related U.S. Application Data

(60) Provisional application No. 61/328,693, filed on Apr. 28, 2010.

(51) Int. Cl.
*H01Q 21/00* (2006.01)
*H01Q 3/24* (2006.01)

(52) U.S. Cl.
USPC ..... 343/816; 343/820; 343/876

(58) Field of Classification Search
USPC ..... 343/814, 816, 820, 876
See application file for complete search history.

(56) References Cited

U.S. PATENT DOCUMENTS

| | | | | |
|---|---|---|---|---|
| 4,125,841 | A | | 11/1978 | Munk |
| 5,434,575 | A | * | 7/1995 | Jelinek et al. ..... 342/365 |
| 6,005,530 | A | * | 12/1999 | Jovanovich et al. ..... 343/827 |
| 6,512,487 | B1 | | 1/2003 | Taylor et al. |
| 6,552,687 | B1 | | 4/2003 | Rawnick et al. |
| 6,771,221 | B2 | | 8/2004 | Rawnick et al. |
| 7,084,827 | B1 | | 8/2006 | Strange et al. |

* cited by examiner

*Primary Examiner* — Hoang V Nguyen
(74) *Attorney, Agent, or Firm* — Daniel J. Long; Robert K. Tendler

(57) ABSTRACT

The replacement and elimination of duplexers in a tightly coupled dipole phased array starts with transmit and receive functions physically separated and having different antenna port feeds. The simple coupling network used with tightly coupled dipole arrays is replaced by a state switch which alternates between a coupling state and a dipole feed connection state. The basic method can be applied to antenna apertures of various kinds, including both linear and dual polarized versions. The ability to locate state switches at various nodes in tightly coupled dipole phased arrays permits flexibility in antenna design and eliminates bulky and lossy components, simplifies the design requirements and allows independent optimization of the components.

19 Claims, 20 Drawing Sheets

METHOD AND APPARATUS FOR ELIMINATION OF DUPLEXERS IN TRANSMIT/RECEIVE PHASED ARRAY ANTENNAS

RELATED APPLICATIONS

This application claims rights under 35 USC §119(e) from U.S. Application Ser. No. 61/328,693 filed Apr. 28, 2010, the contents of which are incorporated herein by reference.

FIELD OF THE INVENTION

This invention relates to closely or tightly coupled dipole arrays and more particularly to a method and apparatus for elimination of duplexers in transmit/receive phased array antennas.

BACKGROUND OF THE INVENTION

As illustrated in U.S. Pat. No. 6,512,487 entitled Wide Band Phased Array Antenna and Associated Methods; U.S. Pat. No. 6,771,221 entitled Enhanced Bandwidth Dual Layer Current Sheet Antenna; U.S. Pat. No. 7,084,827 entitled Phased Array Antenna with an Impedance Matching Layer and Associated Methods; as well as U.S. Pat. No. 6,552,687 entitled Enhanced Bandwidth Single Layer Current Sheet Antenna, arrays of closely or tightly coupled dipole arrays are described. These inventions are based on an invention by Benedict A. Munk described in U.S. Pat. No. 4,125,841 entitled Space Filter. It is reported that it was Munk's invention to add a coupling element at the end of each half wavelength dipole to allow the phased array to be exceedingly broadbanded.

It is noted that the dipole itself is capable of an octave bandwidth, whereas derivative antennas approach a decade of bandwidth assuming the appropriate kind of coupling design between the dipoles. Moreover, planar two dimensional arrays of a sheet of dipoles increase gain or directivity; and by adding coupling in orthogonal directions one can also achieve multiple polarizations for the phased array.

Applications for such planar phased arrays are in general for broadband surveillance, electronic warfare applications and any applications which require very broadband phased arrays.

When utilizing such closely coupled dipole arrays for transmit/receive operations, it is common to provide either a circulator or a double pole, double-throw transmit/receive switch at each of the feeds of the dipoles in order to isolate the transmitter from the receiver and vice versa. The circulators and transmit/receive switches are in general referred to as duplexers. However, when it is intended for these antennas to be driven in the transmit and receive modes alternately, placing a circulator or transmit/receive switch at each of the antenna feeds for the dipoles can be physically impossible, depending on frequency of operation, due to the limitations of the physical size of such circulators and switches which precludes their use above the ground plane normally used for such planar arrays.

For instance, circulators tend to be too large at the frequencies of interest. This is because the spacing between the electronics is approximately one half wavelength at the operating frequency. Note that at the highest frequency for which the antenna will operate, the spacing between the elements needs to be no more than one half wavelength at this frequency. Duplexers in the form of circulators and T/R switches are much too large to be placed at the feedpoint of a dipole, especially when these duplexing units are above the ground plane for the planar array. Moreover, the typical circulators are bandwidth-limited and TR switches have excessive losses. Thus T/R switches absorb power during the transmission process and limit sensitivity on the receive side. It will be appreciated that for a decade bandwidth switch there could be as much as a dB loss or even more if high power switches are used. Note also that any piece of electronics that is interposed between the receiver or transmitter and the antenna will have parasitics that will limit the bandwidth.

In summary, circulators have limited bandwidth, limited usually to an octave. Moreover, circulators get bulkier and lossier as one seeks to achieve a 5:1 bandwidth. Thus, using a circulator limits the bandwidth performance. On the other hand, transmit/receive switches with pin diodes result in unacceptable losses that limit performance. Moreover, dipoles require balanced inputs and the use of baluns to convert an unbalanced line to a balanced line is undesirable due to the added parasitics and losses.

Two other factors which further complicate phased array implementations of circulators include the use of high field strength bias magnets which must be shielded to prevent interaction with the shielding significantly adding to the bulk of the structure.

Finally as mentioned above, balanced lines require baluns which are differential single ended to balanced devices required between the feed and the circulator, or the feed and the transmit receive switch. The use of baluns adds additional circuitry which further degrades performance in terms of loss, match and bandwidth.

Such weight and size limitations as well as limitations on performance are particularly acute when, for instance, planar arrays of miniature dipoles exceed 1,000×1,000 dipole arrays or greater. While it is theoretically possible to locate the duplexing circuitry beneath the ground plane of the antenna, it is highly desirable to be able to eliminate duplexers so as to be able to fabricate reasonable size and planar arrays, with the antenna elements existing above the ground plane. In short, there is a need to eliminate the large amount of electronics directly connected at the feed of these antennas when contemplating transmit/receive functions.

SUMMARY OF INVENTION

It is part of the subject invention to replace or eliminate the duplexers in a tightly coupled dipole phased array by recognizing that it is possible to separate the transmit and receive functions by locating a state switch either at the normal feedpoint of a dipole or between the ends of adjacent dipoles that would normally carry a capacitance coupling. The state switch alternates between a coupling state and a dipole feed connection state such that in a transmitting state a state switch is activated for direct feed across opposed quarter wave dipole elements, whereas in a receive state coupling elements are switched across adjacent dipole ends.

By connecting transmit elements and receive elements between successive quarter wave dipole elements in a line of dipoles and by appropriate switching of the state switches one can configure the antenna array for either a transmit mode or a receive mode, with the transmit element, the receive element and appropriate state switches switched in accordance with the receive or transmit mode required.

In one embodiment, the dipoles are interleaved such that dipoles are fed through a state switch at a dipole feedpoint and are provided with capacitive coupling through a state switch at another point, namely between opposed dipole ends. Thus in the transmit mode the state switch at one point is switched to act as a direct feed to the feedpoint of a dipole, whereas in the receive state, a state switch at an adjacent point switches a capacitive element across adjacent dipole ends.

The result is that one can provide minimal electronics at the feedpoints of the dipole or adjacent dipole ends above the ground plane such that one can have very large numbers of transmit/receive elements in a planar array and switch the array between transmit and receive modes without the use of duplexers, either in the form of circulators or DPDT T/R switches. Moreover, state switches employ minimal electronics making them deployable at the spaced-apart ends of opposed λ/4 dipole elements. Thus, the present invention eliminates the need to have either a circulator or a transmit/receive switch at a dipole feed by separating the points at which one places the transmit and receive elements. No longer is the dipole feedpoint used for both transmit and receive functions.

Key to this is the understanding that one can feed the antenna at places where a capacitive coupling originally was coupled between the ends of adjacent dipoles. Normally it was thought that dipoles could only be fed at a single feed point. However, in planar arrays of dipoles, adjacent quarter wave dipole elements exist not only at what was traditionally thought of as the feedpoint, but also at the ends of adjacent dipoles.

As a result of locating state switches at various points one has achieved considerable flexibility since one can separate out the transmit and receive functions by simply distributing the transmit and receive elements and controlling associated state switches.

What is happening is that one has an array of transmitter and receiver antennas in which in one instance the receiver uses one pair of quarter wave dipole elements, but in the transmit sequence one uses a different pair of quarter wave dipole elements. It will thus be appreciated that the same quarter wave dipole element may serve in one instance as part of a transmit antenna and in the alternate mode as part of a receive antenna.

In one embodiment, the state switch includes a pair of single-pole double-throw switches which are coupled between opposed quarter wave dipole elements and then are switched either towards the pair of electronic inputs or towards a coupling impedance that places a coupling impedance between the dipole elements. Thus one is switching the coupling impedance in and out, or one is switching the direct feed to the transmitter in and out.

Note that the state switch is simpler than the kind of transmit/receive switches that in general involve a double-pole double-throw switch. Having a pair of single-pole double-throw switches involves half of the complexity of a double-pole double-throw switch. Note that for a double-pole double-throw switch one would need four single-pole single-throw switches, whereas in the subject case one only utilizes two single-pole double-throw switches. Having half the complexity results in half of the parasitics and half of the losses, as well as half of the bandwidth restriction as compared with the standard double-pole double-throw switch. Thus, the subject state switch has one half the total impact of a double-pole double-throw switch.

In summary, the replacement and elimination of duplexers in a tightly coupled dipole phased array starts with transmit and receive functions physically separated and having different antenna port feeds. The simple coupling network used with tightly coupled dipole arrays is replaced by a state switch which alternates between a coupling state and a dipole feed connection state. The basic method can be applied to antenna apertures of various kinds, including both linear and dual polarized versions. The ability to locate state switches at various nodes in tightly coupled dipole phased arrays permits flexibility in antenna design and eliminates bulky and lossy components, simplifies the design requirements and allows independent optimization of the components.

BRIEF DESCRIPTION OF THE DRAWINGS

These and other features of the subject invention will be better understood in connection with the Detailed Description, in conjunction with the Drawings, of which:

FIG. 8B is a diagrammatic illustration of the array of FIG. 7 in which a receive element is off and a transmit element is on;

DETAILED DESCRIPTION

As shown in U.S. Pat. No. 6,512,487, a wideband phased array antenna 10 is mounted to the nose cone of an aircraft 12 or other rigid mounting member having a non-planar three dimensional shape. As shown, the array is connected to a transmit/receive controller 14 for alternately driving the antenna or receiving signals.

Figure 1:
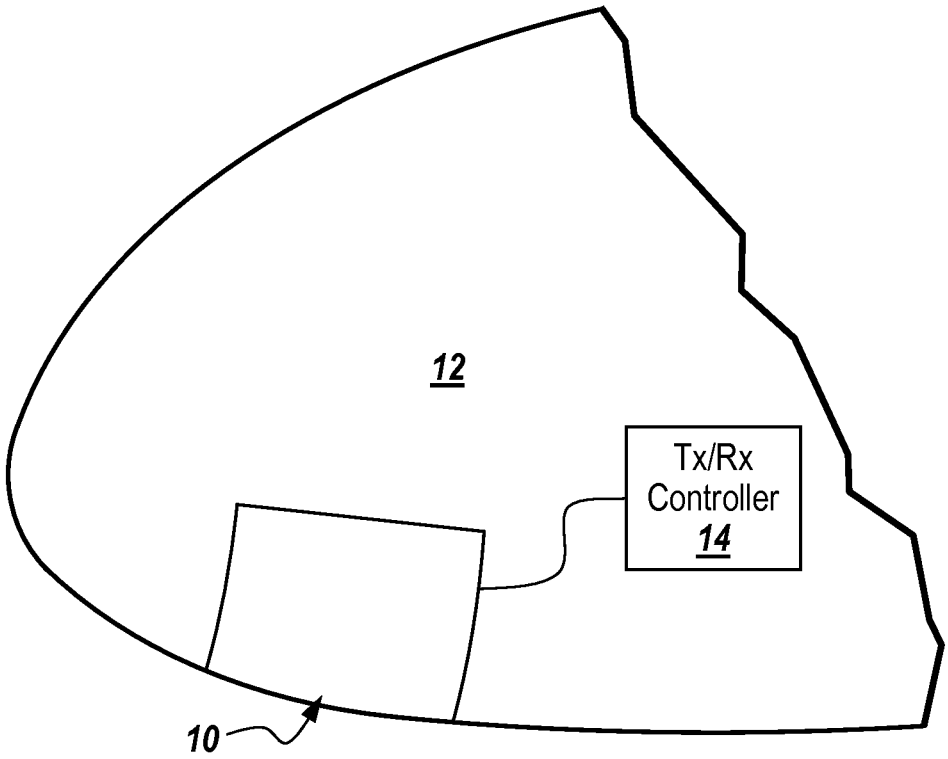
Fig. 1 (Prior Art)
FIG. 1 is a prior art description of the mounting of a planar array on a vehicle illustrating a TX/RX controller coupled to the planar array.
Figure 2:
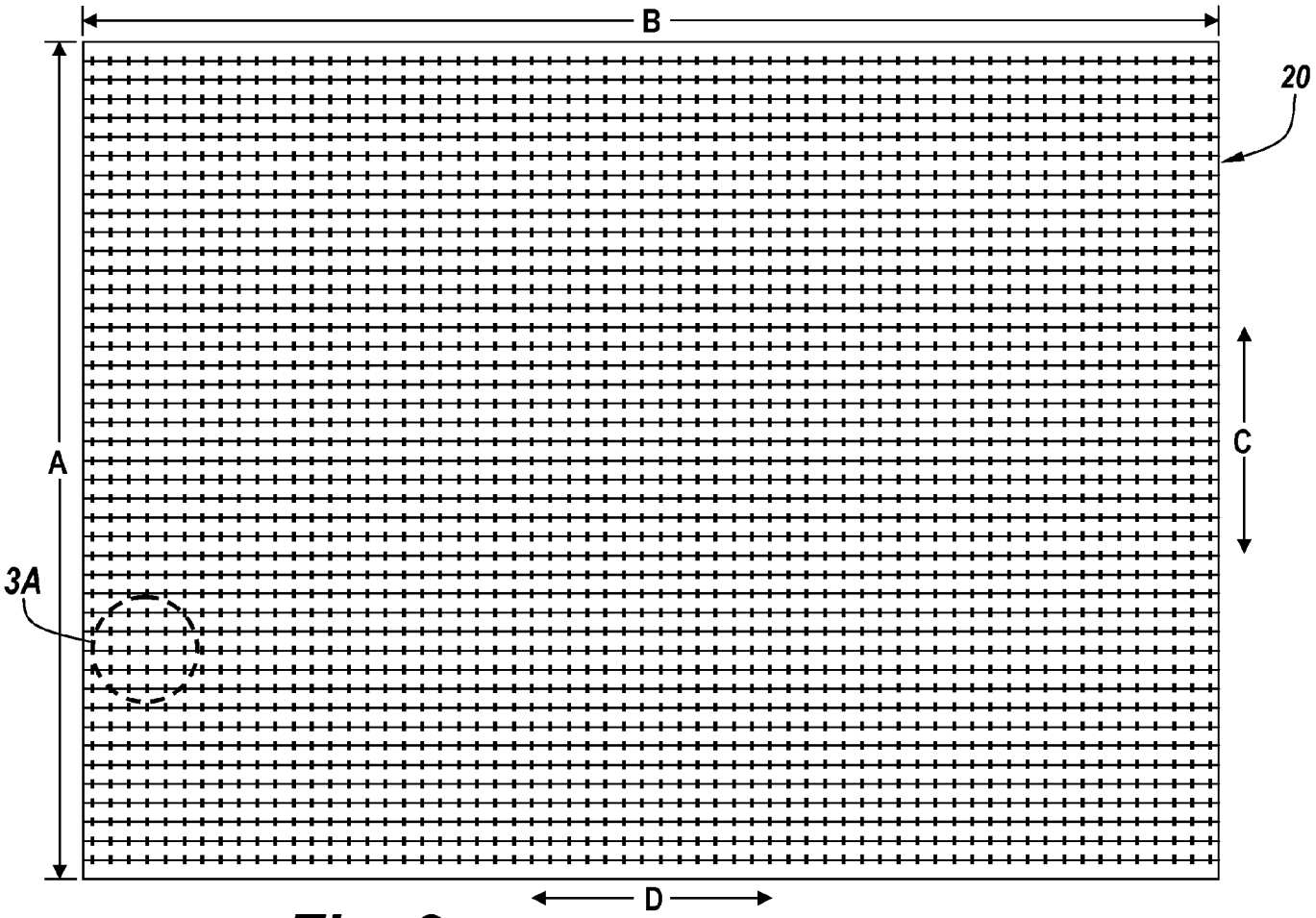
Fig. 2 (Prior Art)
FIG. 2 is a diagrammatic illustration of the planar array of FIG. 1 illustrating linear arrays of dipoles.
Figure 3:
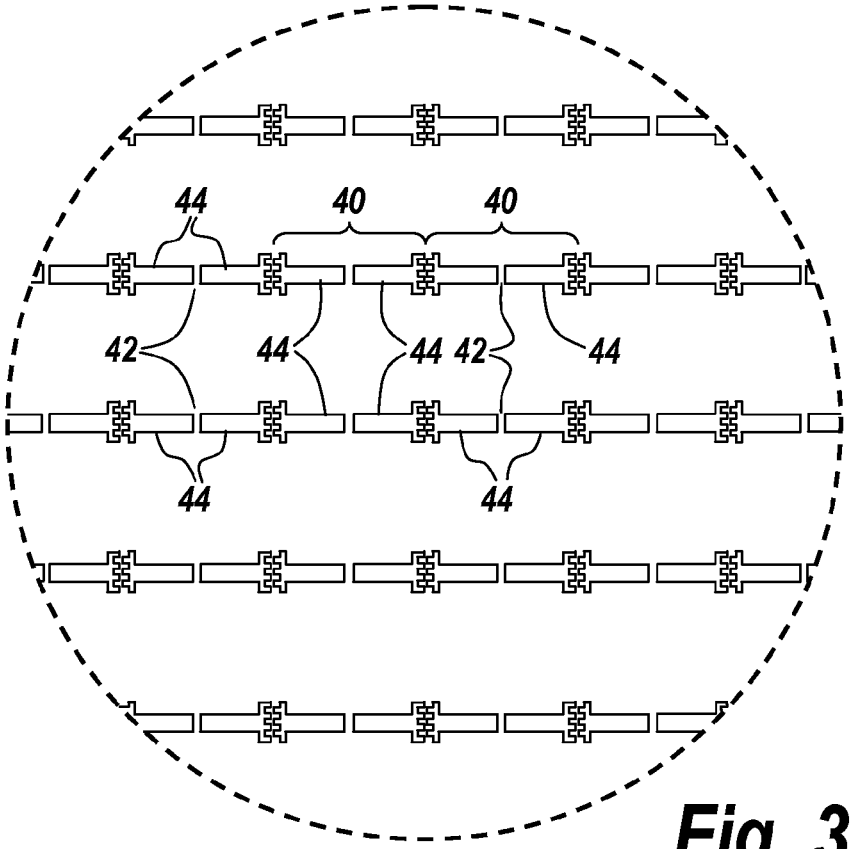
Fig. 3 (Prior Art)
FIG. 3 is an expanded view of a portion of the array of FIG. 2 illustrating individual dipoles having the ends thereof capacitively coupled together.

This array is a closely or tightly coupled dipole array such that as shown in FIG. 2 there is a dipole layer 20 which in one embodiment is comprised of a conductive layer having an array of dipole elements printed thereon. As can be seen by the exploded view of FIG. 3 each of the dipole elements 40 includes a feed 42 between adjacent dipole ends 44.

Figure 4:
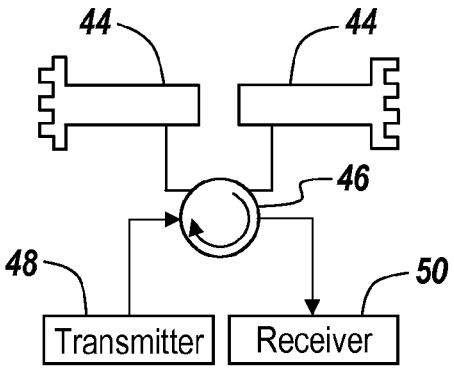
Fig. 4 (Prior Art)
FIG. 4 is a diagrammatic illustration of a prior art system for connecting to the dipoles of FIG. 3 in which a circulator is utilized to separate out the signals from a transmitter to the dipole and receive signals from the dipole.

As shown in FIG. 4, the array requires isolation of the transmitter from the receiver. Here, dipole elements 44 are connected to a circulator 46 which couples transmit element 48 to dipole 44 during a transmit mode, and receive element 50 to the dipole elements during a receive mode. This constitutes one embodiment of a duplexer which protects the receiver from outgoing energy coupled to the dipole during the transmit mode and which isolates the transmitter from the receiver during the receive mode.

Figure 5:
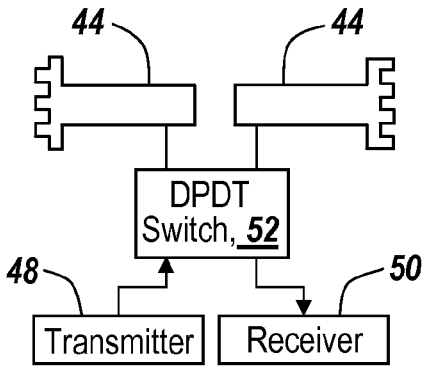
Fig. 5 (Prior Art)
FIG. 5 is a prior art illustration of the utilization of a double-pole double-throw switch as a transmit/receive switch between a transmitter and a receiver coupled to a dipole of FIG. 3.

Referring to FIG. 5, the duplexer may be alternatively configured as a double-pole double-throw switch 52 coupled between dipole elements 44 and transmitter element 48 and receiver element 50 to provide the same function as the circulator of FIG. 4.

Figure 6:
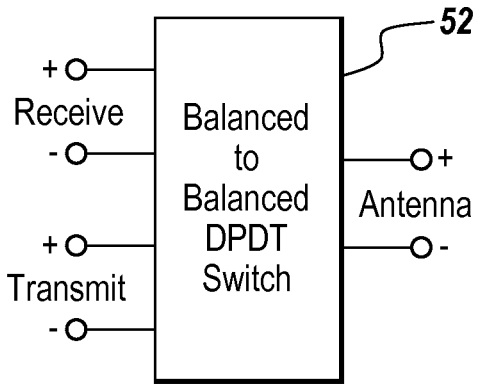
FIG. 6 is a diagrammatic illustration of a balanced to balanced double-pole double-throw switch for utilization of the transmit/receive switch of FIG. 5.

As to the configuration of the transmit/receive switch 52, typically as shown in FIG. 6 switch 52 is a balanced to balanced double-pole to double-throw switch which, inter alia, may include baluns so that unbalanced lines may be connected to the dipole antenna which has typically a balanced feed.

More particularly, for an array configured for combined transmit and receive (T/R) operation, a duplexer is added at the antenna feed to separate the transmitter from the receiver. The circulator is the most commonly used form of the duplexer, whose purpose is to separate the transmit and receive paths from each other at the antenna connection, as well as to provide isolation and reduce unwanted reflections and interactions among the components.

The circulator for a wide bandwidth phased array is a bottle neck to system design and performance. Typically for a circulator it is possible to get extremely good performance over less than an octave bandwidth. For a circulator moderately good performance with 10 dB of return loss and 15 dB of isolation can be achieved at up to about 3:1 bandwidth. Bandwidths of 10:1 are not feasible with available circulator technology.

Two other factors further complicate phased array implementations of circulators. First, bias magnets of sufficiently high field strength must be shielded from each other. This significantly adds to the bulk of the structure. Moreover, broadband phased arrays tend to be comprised of elements that have differential (balanced) feeds. Either pairs of circulators would be required at each antenna element feed, or a broad bandwidth balun component is needed between the feed and the circulator. This additional circuitry further degrades the performance of the antenna in terms of loss, match, and bandwidth.

Clearly some alternate implementation is required for the wideband duplexer. Y. Ayasli, "Field Effect Transistor Circulators," 1989 IEEE Trans. On Magn., vol. 25, pp. 3242-3247, the contents of which are incorporated herein by reference, and others have described methodologies for active circulators using microwave transistors and exploiting the unilateral property of transistors. That is they have gain from input to output but attenuate signals from the output to the input. Care must be taken to assure stability of these circuits. Unfortunately active circulators tend to generate excess noise, limiting input sensitivity, while also limiting the output power in the transmit arm. Methods that rely on frequency conversion, using optical or other techniques, have the additional limitation on dynamic range due to nonlinearities in the up and down conversion.

Note, any non-balanced or single ended duplexer solution would require a broad band balun to connect to the antenna. Typical microwave baluns operate over 3:1 bandwidths, with decade bandwidths also feasible as described in D. Meharry, "Decade Bandwidth Planar MMIC Balun," IEEE MTT-S Digest, 2006, the contents of which are incorporated herein by reference. However, baluns add losses and are limited in their ability to present good match over a very wide bandwidth.

Balanced antenna elements with balanced (differential) electronics may be the best way to achieve good performance over very broad bandwidths. This conceptually involves a double-pole double-throw switch. However, this approach still has limitations. Primarily this is because of the complexity of the circulator that has to be positioned at a single small location. The transmit and receive connections are by necessity very close to each other, creating potential issues with isolation. Furthermore, it is difficult to maintain symmetry and balance in the overlapping interconnections. Finally, the actual receive and transmit electronics connections will have to be moved further away from the antenna interface to allow for the space to package the individual receive and transmit components. All of these factors increase complexity and make it more difficult to achieve bandwidth match over the entire bandwidth.

The requirement of a duplexer connected between a balanced antenna and the receive and transmit ports of the system translates into a high degree of microwave complexity in a very confined space at the antenna feed. An additional requirement of dual polarization will more than double the associated complexity. It may also require twisting or other complications of the interconnection scheme. Parasitic effects of the microwave junctions compound the difficulties of achieving a high degree of match over extended bandwidths, at the same time having a direct impact on transmit power and efficiency and on receive sensitivity and dynamic range. This situation is also complicated by the need to remove the heat generated in this confined space.

Figure 7:
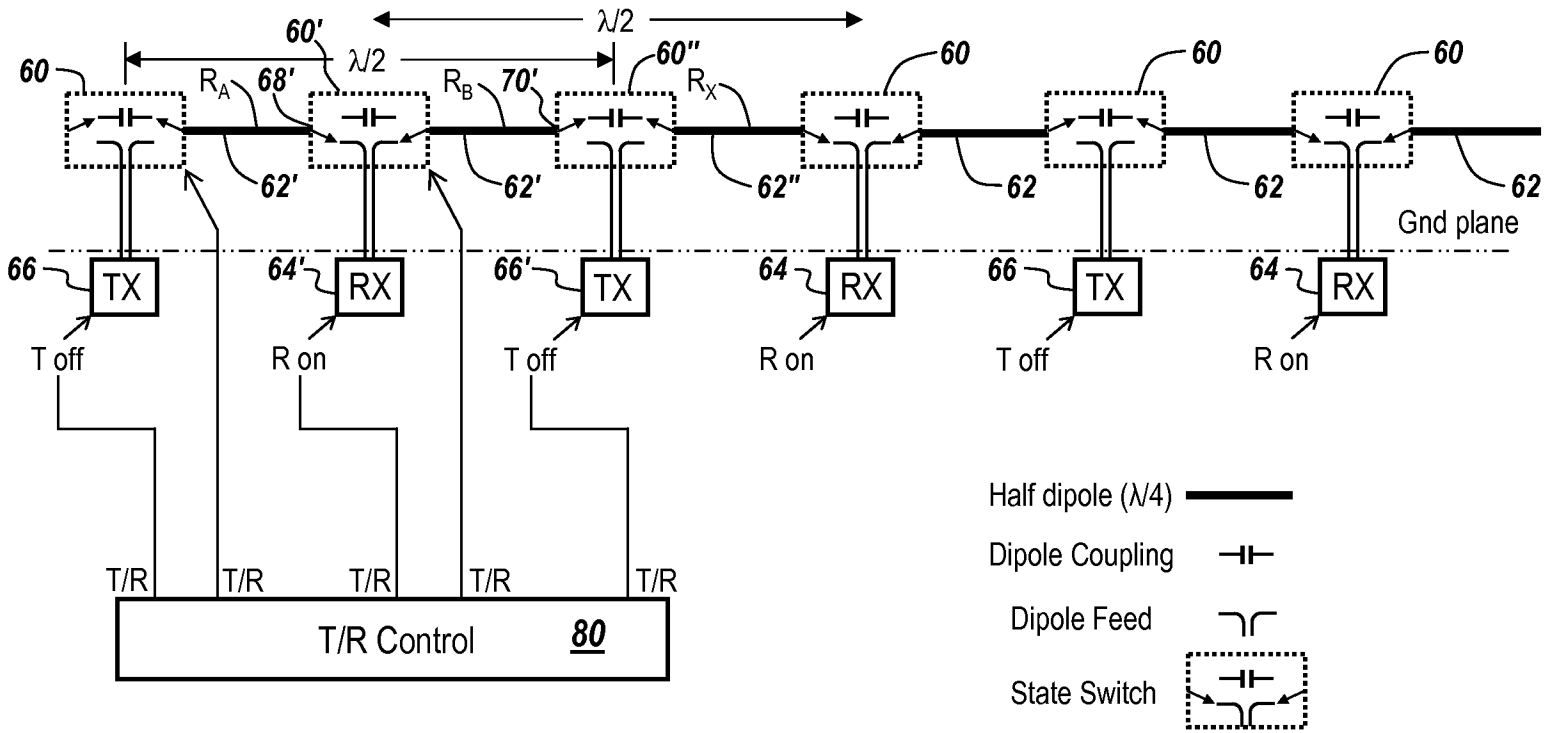
FIG. 7 is a diagrammatic illustration of the utilization of a state switch between quarter wave dipole elements of a linear array of dipoles in which state switches are controlled to couple a capacitance element between opposed ends of the dipoles or to couple feed lines between quarter wave dipole elements, with transmit and receive elements being switched by the control unit, also showing the interleaved dipole structure in which dipoles overlap to share a common quarter wave element.

Referring to FIG. 7, in the subject invention state switches 60 are positioned across the ends of opposed quarter wave dipole elements 62. Switches 60 alternately connect the opposed ends of the dipole elements to transmitter or receive elements or capacitively couple the opposed ends together. In FIG. 7 the receive elements 64 are turned on, whereas the transmit elements 66 are turned off, thus to provide the array with a receive function. In this configuration in each of the state switches 60, arrows point in the direction of the connection between adjacent dipole elements 62. In this case a receive element 64' is coupled to a state switch 60' such that the state switch couples the receive element to opposed quarter wave dipole ends 68', with distal end 70' of dipole element 62 being capacitively coupled to opposed dipole end 72' through capacitive coupling element 74' in a state switch 60".

It will be appreciated that each of the state switches is interposed between opposed quarter wave dipole element ends and function either to connect the opposed dipole element ends directly to the transmit element, or to capacitively interconnect the opposed dipole ends.

As seen, the state elements are under control of a transmit/receive control unit 80 so as to control the state of the state switches such that successive state switches have opposite switching configurations.

As shown, this means that in the receive mode state switch 60' couples the receive element directly to the associated quarter wave dipole elements, whereas successive state switch 60" interconnects the adjacent dipole ends through an impedance, such as a capacitor.

It is also noted that transmit/receive control unit 80 is simultaneously coupled to control the transmit element on/off mode for the transmit elements and the receive elements on/off mode for the receive elements.

Here it can be seen that in the receive mode depicted dipole elements 62' are capacitively coupled together and receive element 64 is turned on. Alternatively in a transmit mode in which transmit element 66 is turned on, transmit element 66 is directly coupled to a dipole comprised of dipole element 62' and dipole element 62" such that the overall length of the dipole 62', 62" is again a half wavelength, $\lambda/2$. Here it can be seen that there is an interleaved structure in which in the receive mode dipole element 62' is used with one set of dipole elements in the receive mode, whereas the same dipole element 62' is utilized with another set of dipole elements in the transmit mode.

Figure 8A:
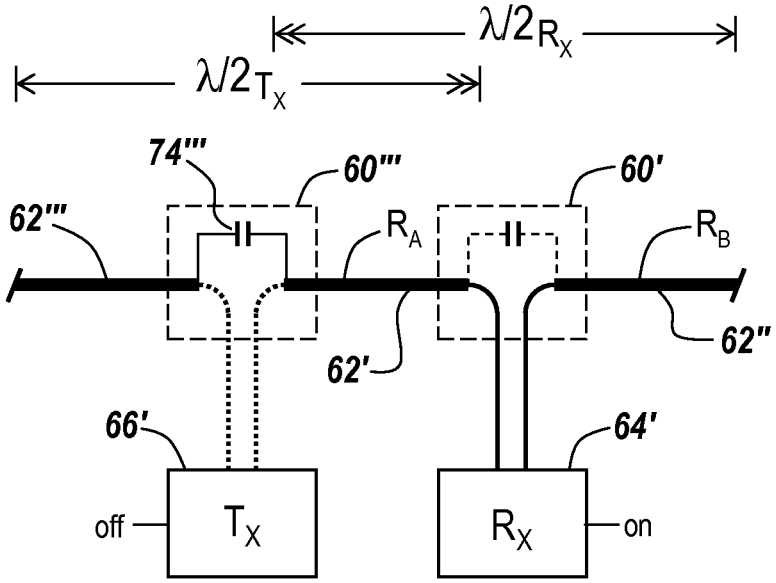
FIG. 8A is a diagrammatic illustration of a portion of the array of FIG. 7 in which a receive element is on and a transmit element is off, indicating a direct connection of the receive element to adjacent quarter wave dipole elements and a capacitive element across different adjacent quarter wave elements.

More particularly and referring now to FIG. 8A in the receive mode in which receive element 64' is turned on, state switch 60' couples the receive element directly to quarter wave dipole elements 62' and 62". At the same time transmit element 64" is turned off and is disconnected from the dipole pair 62' and 62". In this case state switch 60' connects a capacitive element 74' across adjacent dipole element ends.

Figure 8B:
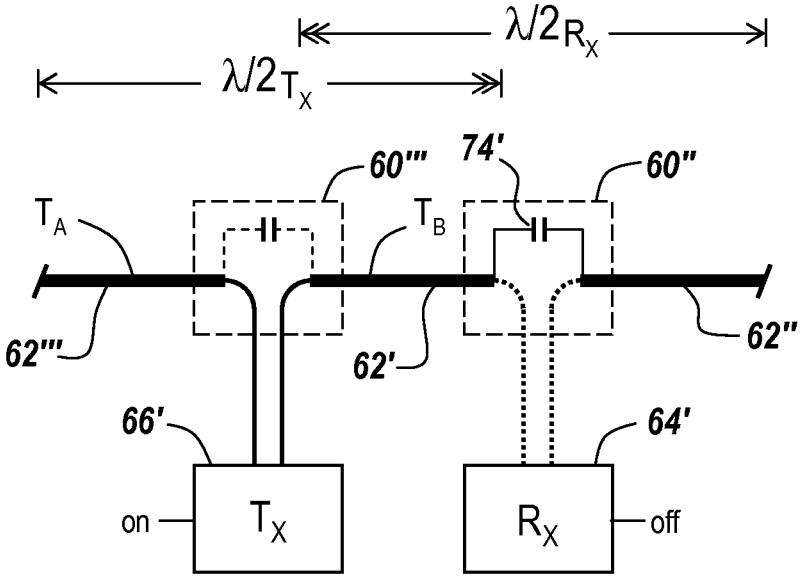

Referring to FIG. 8B, in this transmit embodiment the transmit element 66' is turned on and receive element 64' is turned off. Here the transmit element is directly coupled to element 62''' and element 62' through state switch 60''', whereas state switch 60" now completely disconnects receive element 64' from the associated dipole elements and rather connects capacitive element 74' across the associated opposed dipole ends.

Figure 9:
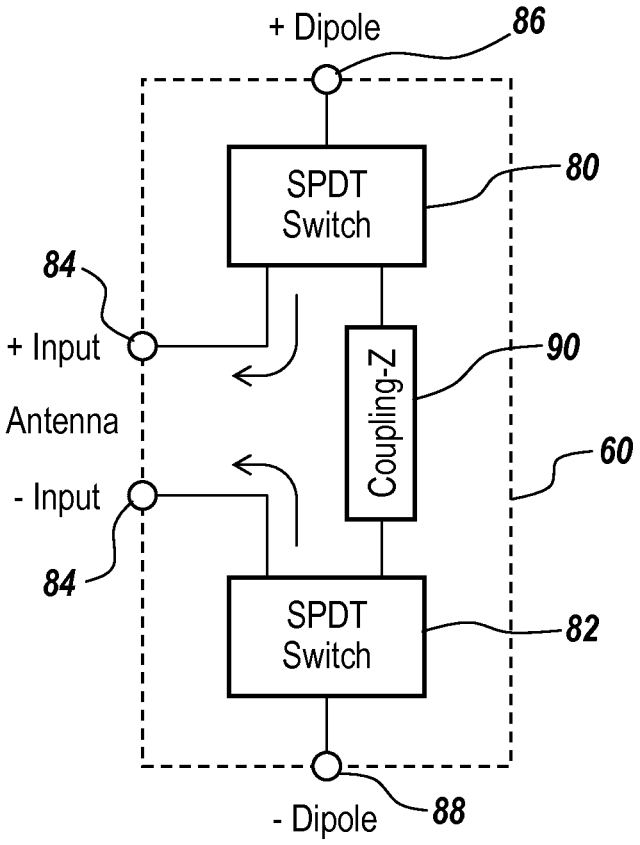
FIG. 9 is a diagrammatic illustration of one embodiment of a state switch in which pair of single-pole double-throw switches is utilized which alternately couple the antenna inputs to feed the dipole elements or couple a capacitive element across opposed dipole elements.

Referring now to FIG. 9, state switch 60 rather than having a double-pole double-throw T/R switch configuration is comprised instead of single-pole double-throw switches 80 and 82 which in one mode connect antenna input 84 to dipole elements 86 and 88.

Alternatively, single-pole double-throw switches 80 and 82 connect a coupling element 90 across dipole elements 86 and 88.

It will be appreciated that the electronic complexity of the solid state switch is at least half that associated with a double-pole double-throw switch configuration common for TR switches. Also note that there are no baluns involved in connecting the antenna input to the dipole.

Thus, when using the tightly coupled dipole array to totally eliminate the duplexer by separating the receive and transmit connection points to the array, this creates interleaved transmit and receive arrays which are offset from each other by a quarter wavelength.

Figure 10A:
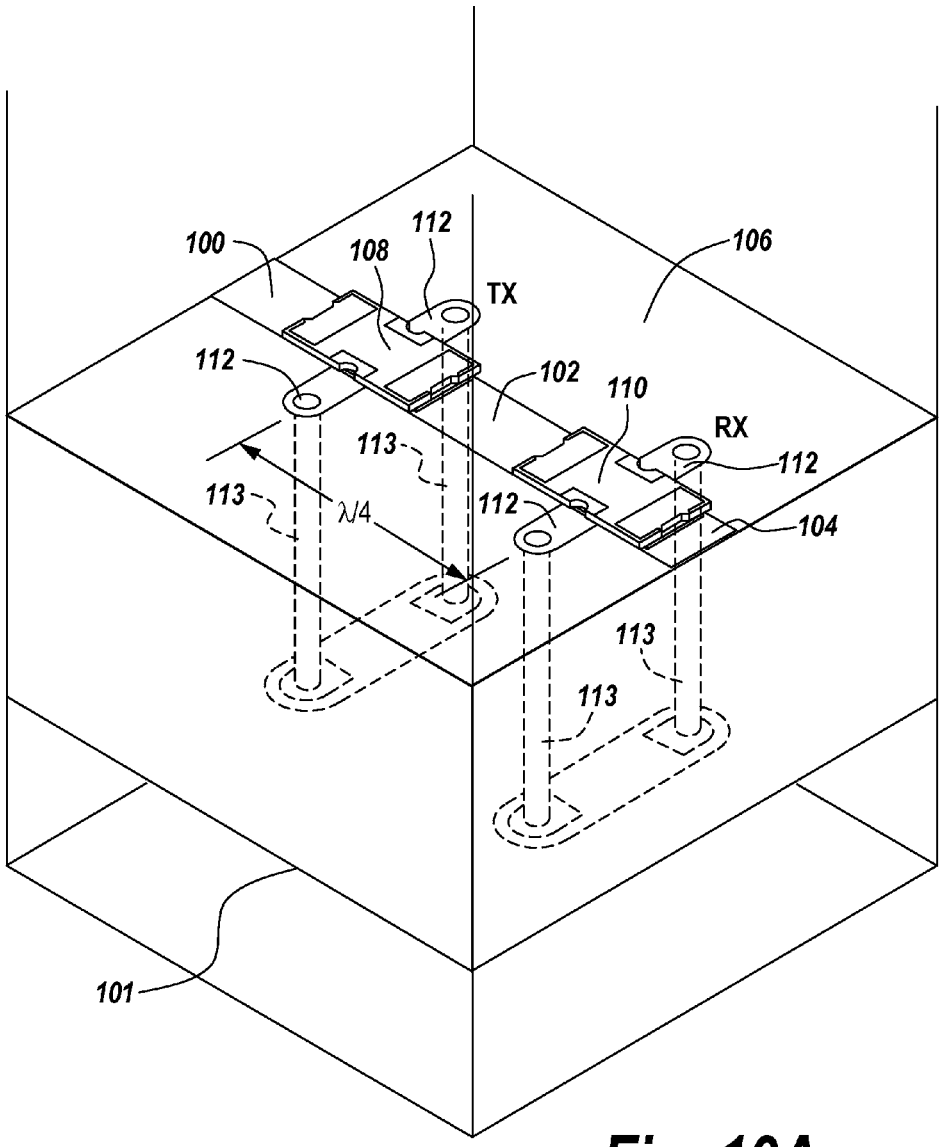
FIGS. 10A, 10B and 10C are diagrammatic illustrations of the physical layout of the state switches between opposed quarter wave dipole ends schematically showing the circuit within a state switch and the conductors extending from tabs on the state switch through the substrate and ground plane that carry both balanced RF and DC signals for controlling the state of the associated state switch.
Figure 10B:
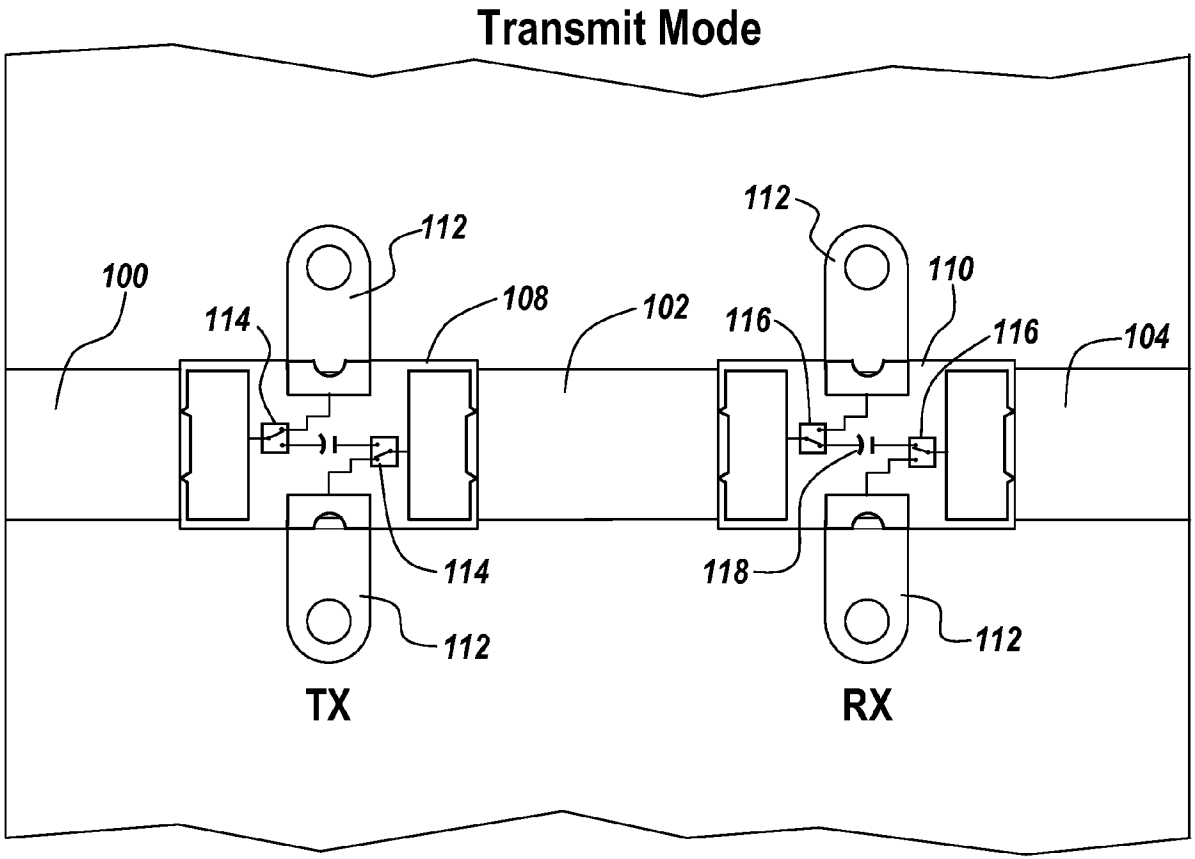
Figure 10C:
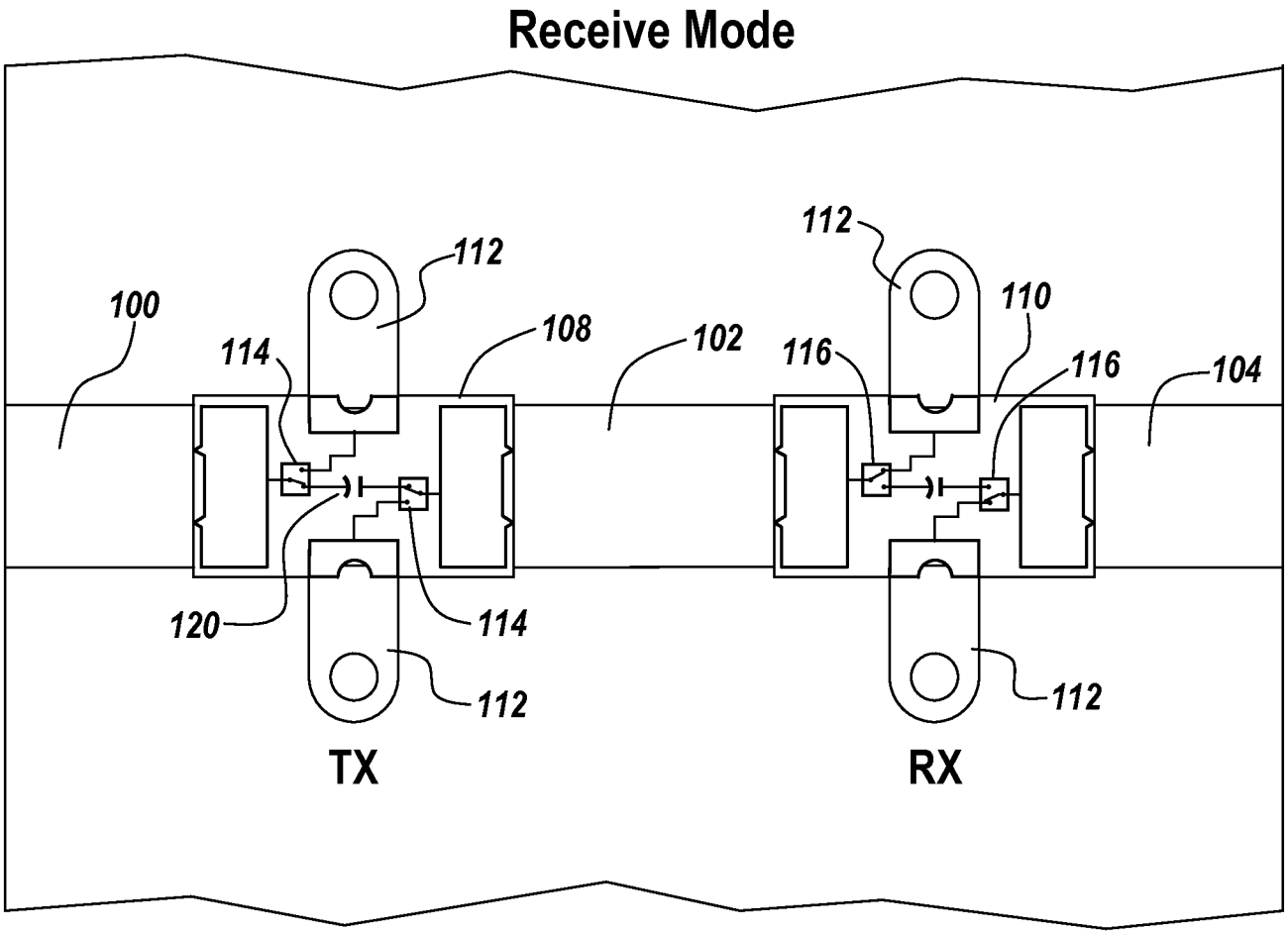

Referring now to FIGS. 10A, 10B and 10C, as to the physical configuration of the dipoles and the associated state switches, as can be seen from FIG. 10A, adjacent quarter wave dipole segments 100, 102 and 104 are located on a planar surface 106 which is situated above the ground plane 101, with state switches 108 and 110 coupled across adjacent quarter wave dipole element ends as illustrated.

Each of the state switches carries tabs 112 coupled through conductors 113 through the mounting surface and through any ground plane 101. These conductors are connected, for instance to T/R control unit 80 of FIG. 7 and to respective transmit or receive elements.

It will be seen that the state switches are spaced sequentially along the dipole elements with a $\lambda/4$ spacing.

Referring to FIG. 10B, in a transmit mode, tabs 112 of state switch 108 are connected by internal single-pole double-throw switches 114 to respective quarter wave dipole elements 100 and 102. State switch 110 has its single-pole double-throw switches 116 connected so that a capacitor 118 is connected between quarter wave dipole elements 102 and 104.

Referring to FIG. 10C, in a receive mode, state switch 108 utilizes switches 114 to connect quarter wave dipole elements 100 and 102 through a capacitor 120, whereas state switch 110 has switches 116 configured to couple tabs 112 to respective to quarter wave dipole elements 102 and 104.

It is noted that direct RF connection to dipole ends is through tabs 112, whereas the capacitive coupling between dipole ends does not require connection below the ground plane. However, DC control signals are impressed on conductors 113 to couple the DC control signals to respective state switches.

Note that RF signals are coupled through conductors 113 when it is required that the state switch connect the associated dipole either to a transmitting element or a receiving element.

More particularly, for a receive only array referring back to FIG. 7, the dipole coupling is replaced with a switching element that alternates between a coupling state and a feed state. In this manner, a feed for a transmit port can be placed at the location of the coupling element in a receive only array. The feed for the receive element has also been replaced by a state switch. The configuration shows the connection for a receive state. Alternating the state switch converts it to a transmit array, offset by $\lambda/4$ at the high frequency end.

The differential transmit and receive amplifiers can be separately and independently optimized for desired performance levels, enabling a simpler, more effective, and higher performance overall solution.

Detailed analyses have been carried out using the 3D finite element simulator (HFSS) to confirm the feasibility of switching a T/R phased array in this manner.

Dual Polarization and Multi-Frequency Operation

Figure 11:
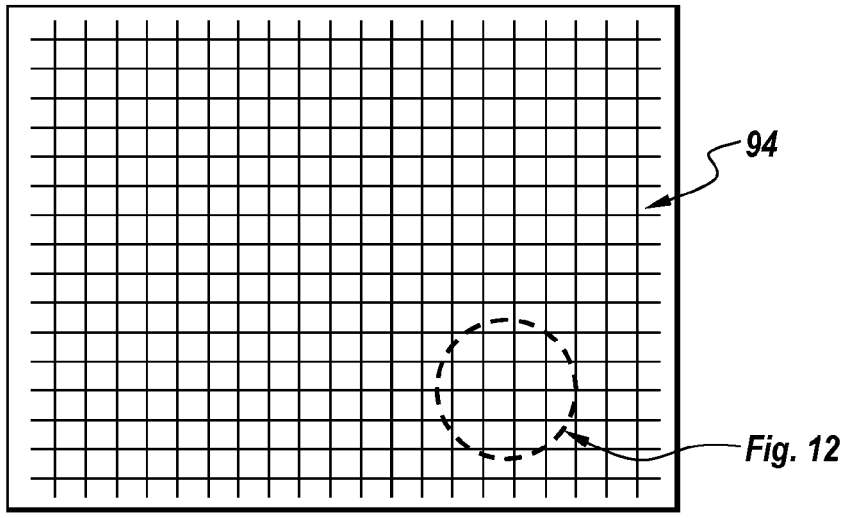
Fig. 11 (Prior Art)
FIG. 11 is a diagrammatic illustration of a prior art planar array in which elements are connected both in the horizontal and the vertical directions.
Figure 12:
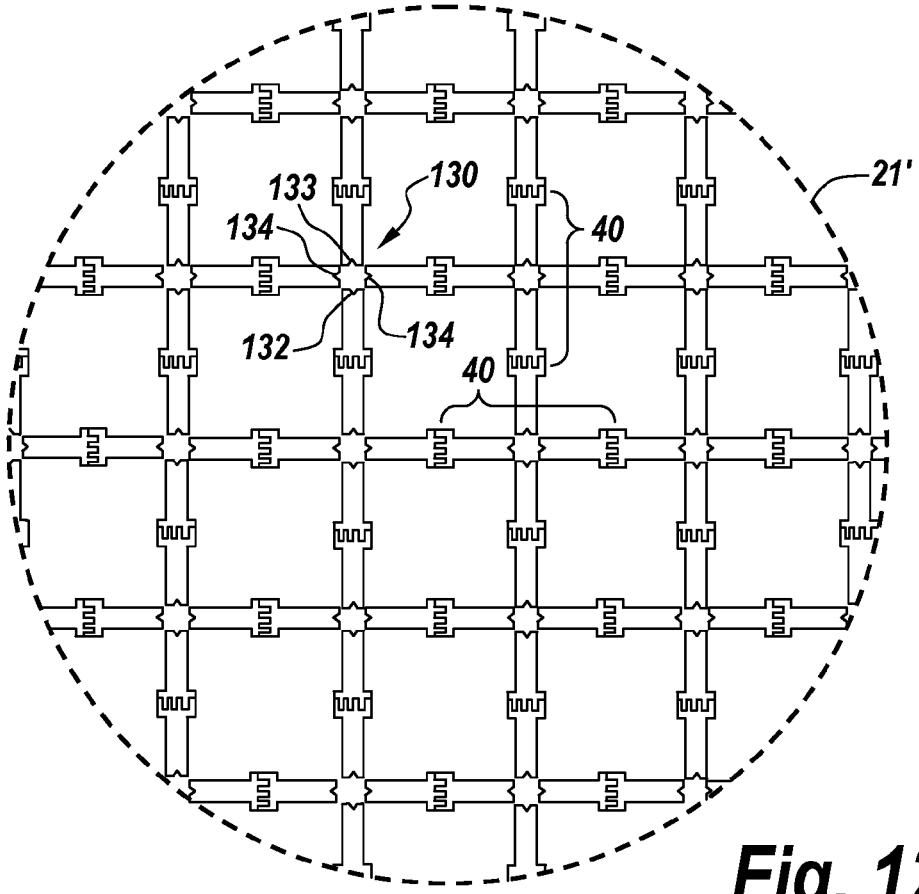
Fig. 12 (Prior Art)
FIG. 12 is a diagrammatic illustration of a portion of the planar array of FIG. 10 illustrating the quad feed of connection of adjacent crossed dipole elements at their respective ends.

Frequently it is necessary for the T/R array to also support dual polarization. A prior art array is shown in FIGS. 11 and 12 which depict a quad feed 130 comprised of feeds 132 for the vertical (Y) polarization and feeds 134 for the horizontal (X) polarization. Here the array is comprised of dipoles 40, with the quad feed providing for dual polarization.

Figure 13:
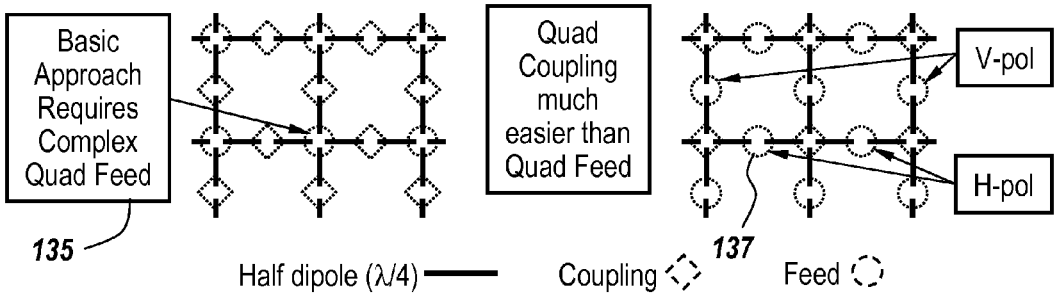
FIG. 13, left, is a diagrammatic illustration of the basic approach of FIG. 12 which requires complex quad feeds at the crossover elements, whereas the subject invention, FIG. 13 right, moves the vertical polarization feed or the horizontal polarization feed to opposed ends of quarter wave dipole elements and restricts the crossover coupling to a capacitive feed, thus reducing feed complexity.

A complication arises from the fact that conventional configurations require a "quad-feed" arrangement where the balanced feeds associated with orthogonal polarizations are at the same point. This is shown at the left hand side of FIG. 13. Connecting to a quad-feed 135 is much more difficult than connecting to a linear feed point 137 on the right hand side of FIG. 13. Here vertical polarization and horizontal polarization feeds are at the less complicated linear feed points.

Figure 14:
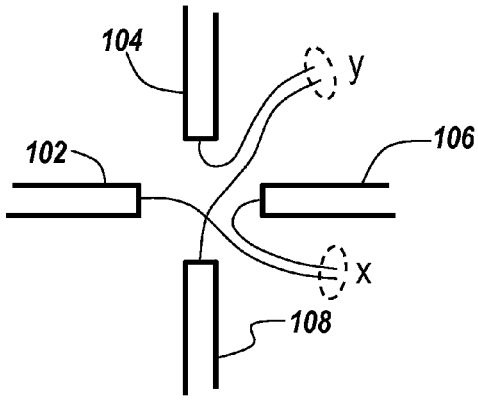
FIG. 14 is a diagrammatic illustration of the complex quad feed of FIG. 13 indicating the requirement of four feed lines to opposed ends of the crossed dipole elements, with opposing feeds paired and adjacent feeds separated to show separation between the horizontal and vertical polarizations.
Figure 15:
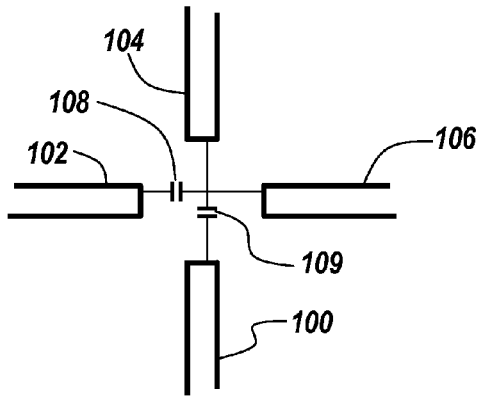
FIG. 15 is a diagrammatic illustration of the crossed elements of an XY array of the subject invention in which only coupling elements need be attached across crossed dipole ends.

As can be seen in FIG. 14, as to quad drive, leads are required from four opposed dipole ends 100, 102, 104 and 106 through a ground plane. Excitation of the X oriented dipole elements arises from the pairing of 102 and 106, and excitation of the Y oriented dipole elements arises from excitation of the pairing of 100 and 104. Any asymmetry imposed on the structure, such as that required when the leads are brought out into a planar configuration, causes unwanted coupling between the two polarizations and degrades antenna performance. As shown in FIG. 15, coupling between opposed dipole ends can be a simple arrangement of crossed capacitors or other coupling elements 108 and 109 connected respectively to dipole ends 100-104 and 102-106.

It is much easier to construct a "quad-coupling" as shown in FIG. 15, because at intermediate points 109 used in the receive mode no RF penetrations of the ground plane are needed. Here only capacitive coupling is required at normal linear array connections. The coupling can even be implemented in a fashion that completely preserves X and Y symmetry. If the coupling is via cross capacitors, sufficient isolation between the capacitors is made possible due to capacitor alignment and configuration. See also equivalent realization of the coupling connection in FIG. 23. Thus, by interchanging the locations of the feed and the coupling network to more convenient locations a much more workable solution is obtained.

More specifically, when one has an orthogonal array of dipoles, crossed dipoles are sometimes fed from the same common point which requires four lines or conductors going to the cross point. However, if one has a transmit only or receive only array then at various points or nodes on the array one need only have capacitors at the crossovers. This requires no control lines or RF lines to the crossover point which greatly simplifies manufacturing. Thus a state switch and embedded circuitry may be positioned at the cross points, but with no control over the state switch and no RF feeds or DC control lines. In this case the state switch coupling capacitors are permanently connected across opposed ends of dipoles. Moreover, with orthogonal crossed dipole arrays one can offset the transmit and receive elements so that one only has active state switches at a non-crossover point.

In an orthogonal array one of necessity has to have cross points, but one can configure the array to have only capacitive elements connected to the ends of opposed dipoles at these cross points.

On the other hand, the RF feed for the orthogonal array may occur at non cross points so that the RF feed is not at a cross point but rather at a more easily accessible feed point.

Note that the coupling elements do not have to have feed points so that the cross point structure may be simplified.

Thus for instance for a receive only array, one can construct the electronic feeds to places where there are no cross points, i.e. at the end of opposed dipoles that do not terminate in a cross point area. Thus, at the cross point area there need not be a state switch at all. The reason for this configuration is because if one is constructing a receive only array there is no need to change states between coupling and feeding. Note also that if it is a transmit only array no state changes are required.

What is done is to eliminate the need for quad feeds at cross points which is a much more complex connection scenario than providing a pair of dipole leads.

Thus, two dimensional or orthogonal arrays have added complications of how everything fits together in terms of where to place the coupling and where to place the electronic feed.

Figure 16:
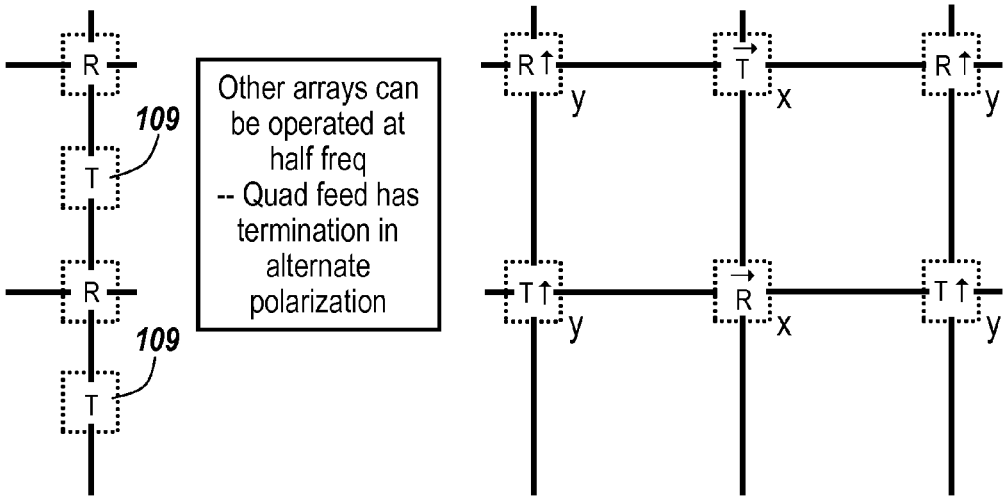
FIG. 16 is a diagrammatic illustration for transmit/receive arrays in which the transmit feeds are simple balanced state feeds, as described previously, and only the receive elements are quad fed, state switching for the low power receive being easier to implement than transmit.
Figure 17:
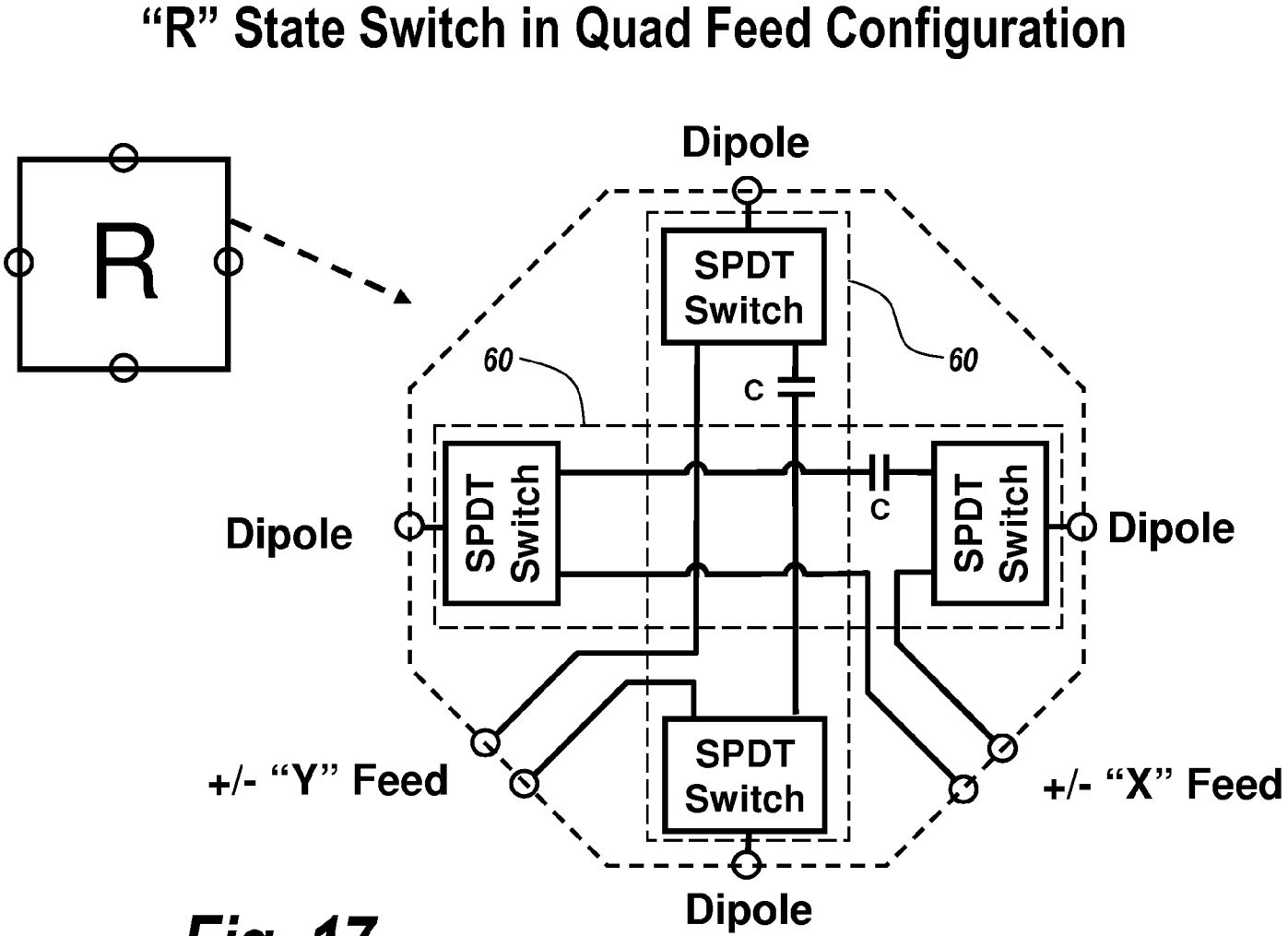
FIG. 17 is a schematic diagram for the state switch of the quad fed receive connection of the array in FIG. 16.

Most importantly, as will be seen in FIG. 16, transmit/receive functionality can be achieved by alternating locations of receive and transmit connection ports in the array. By appropriate placing of transmit and receive elements, one has considerable flexibility. For instance, because of the lower power handling, a quad-configuration for a receive port is easier to implement than for transmit. The transmit state switch is the same as that in FIG. 9. A schematic for a possible implementation of the receive state switch for the quad feed is shown in FIG. 17. Examination of this schematic reveals that it is simply comprised of a pair of the state switches 60 from FIG. 9, one for each polarization.

Figure 18:
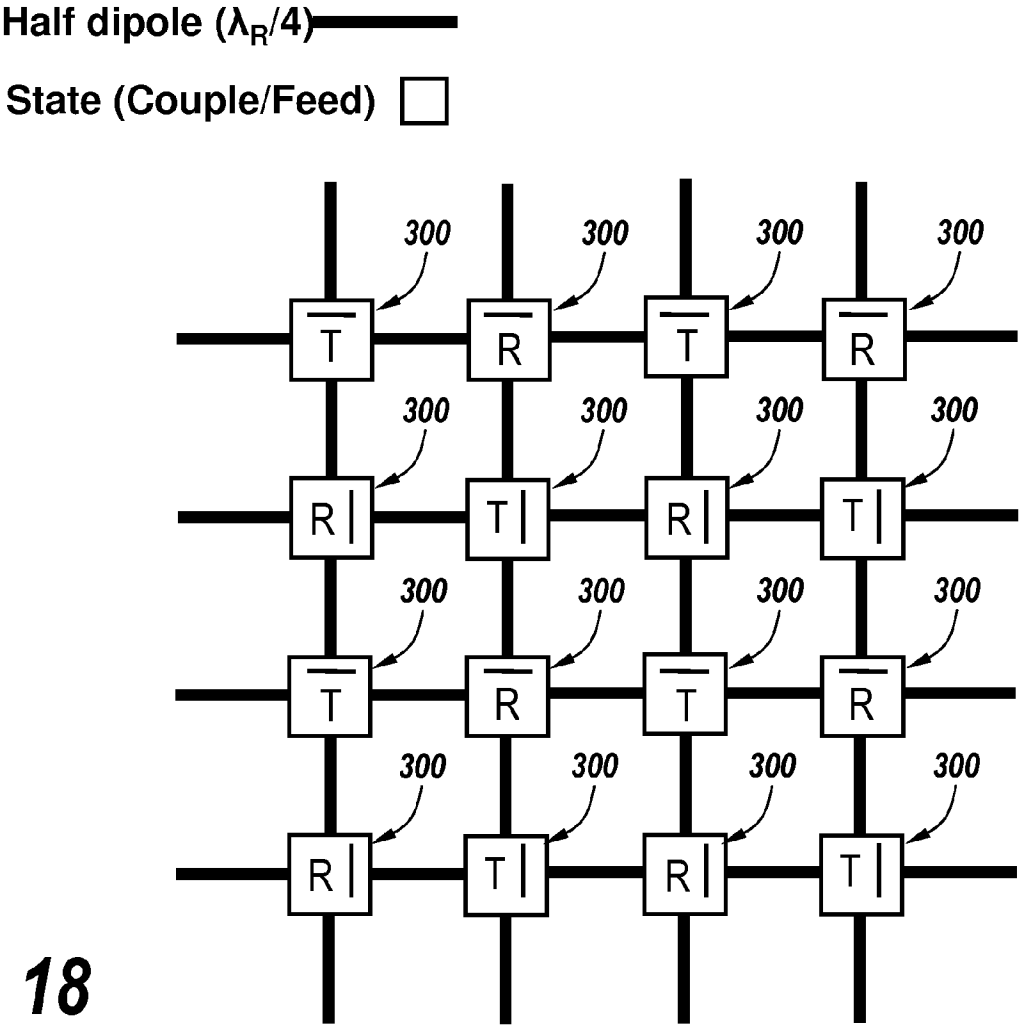
FIG. 18 shows a full T/R array in which the dipole elements are connected through a state switch configuration having a T or R connection in one direction and a coupling connection in the orthogonal direction, the lines inside the box indicating the direction of the connection for T or R, noting quad penetrations of the ground plane are required.
Figure 19:
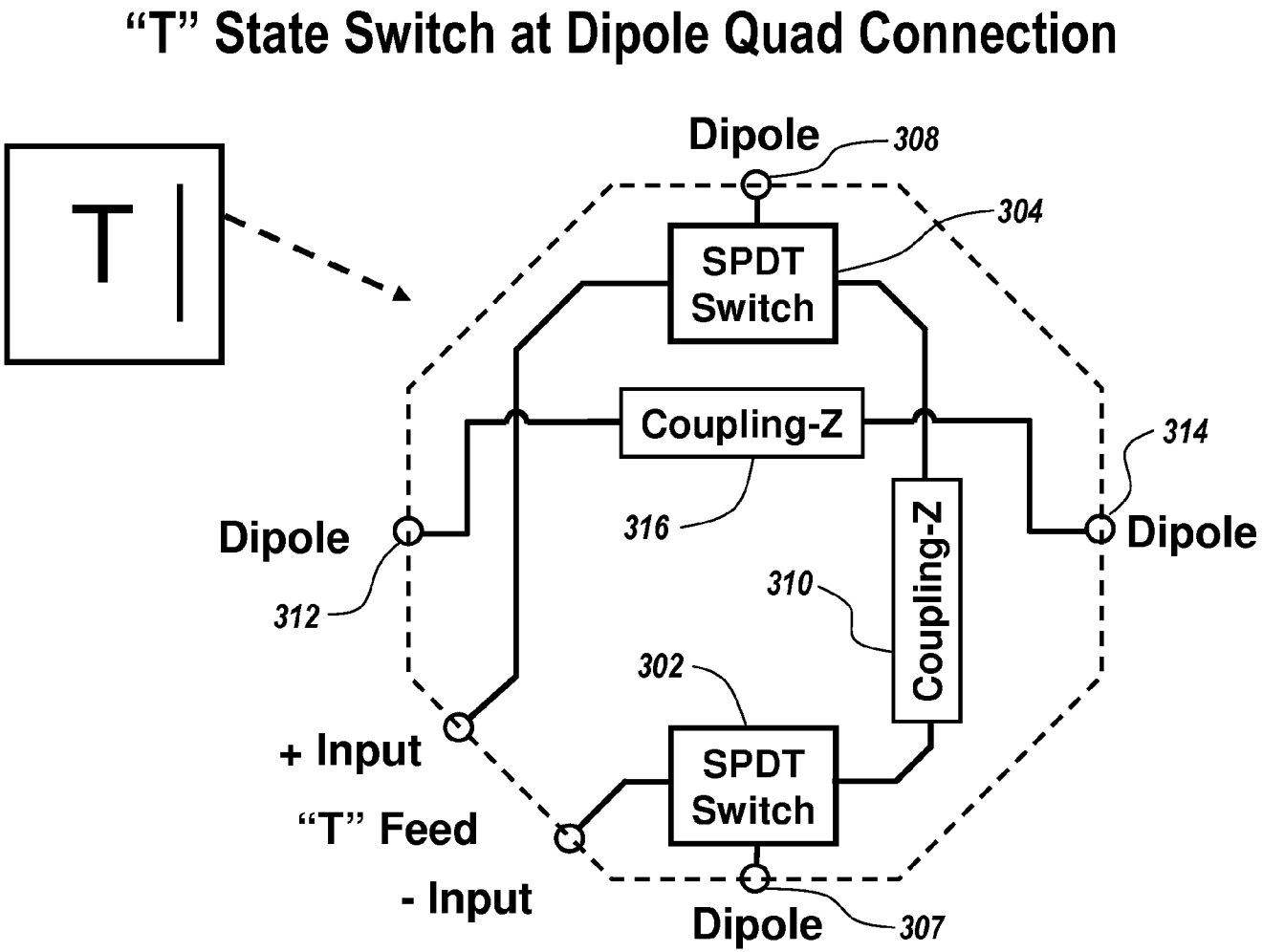
FIG. 19 shows the state switch, including coupling connection, for the array in FIG. 18.

A further option for transmit/receive operation is shown in FIG. 18. In this case the receive and transmit feeds are both located at a quad junction 300 of dipoles. However, there is only a single, balanced penetration of the ground plane, either for transmit or for receive. The polarization of the feed is also indicated by the horizontal or vertical line. Note that the transmit or receive connections that are in the adjacent diagonal positions are of alternate polarization. A coupling connection is also required for the dipoles situated in the orthogonal direction from the transmit or receive connection. A state switch usable for all of the feeds is shown in FIG. 19. Here for the transmit state switch at a dipole quad connection for a "T" feed input one has Single Pole Double Throw SPDT switches 302 and 304 as illustrated which couple dipole ends 306 and 307 respectively to either the input or a coupling impedance 310. Here dipole ends 312 and 314 are coupled together by a coupling impedance 316. Note, it is not necessary to switch the orthogonally connected coupling associated with dipole ends 312 and 314. Note also that the state switch for the "R" feed is identical to that of the "T" feed shown in FIG. 19.

Multi-Frequency Operation

Moreover, the ability to design an antenna structure with extended bandwidth capability offers an opportunity where either a transmit or a receive sub-array can work at half of the frequency capability of the other array. One third frequency and other configurations are a direct extension of the methods used for the one half frequency configuration.

Figure 20:
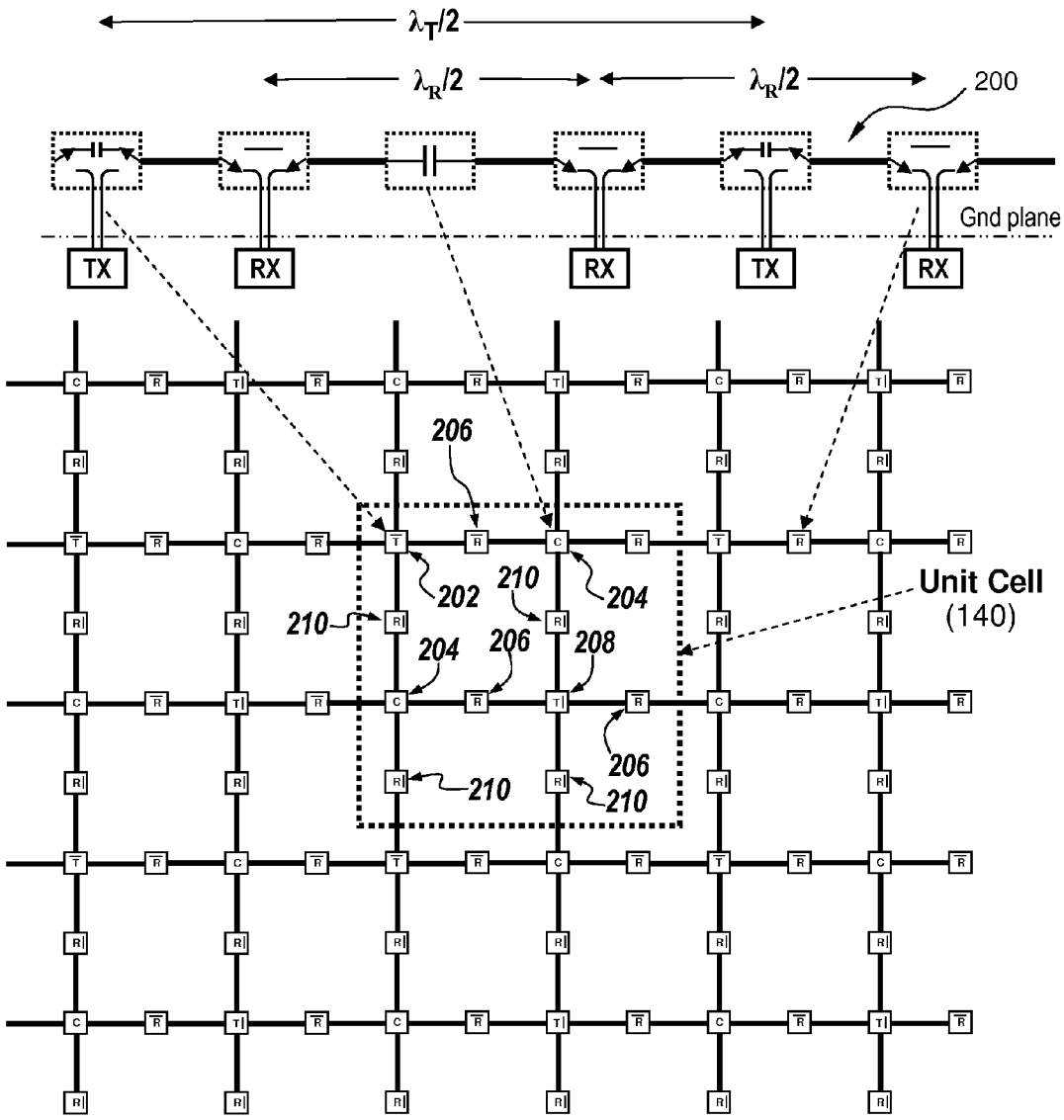
FIG. 20 shows an array in which a unit cell can be configured using the state switches to represent one frequency in a transmit mode and double the frequency in a receive mode.
Figure 21:
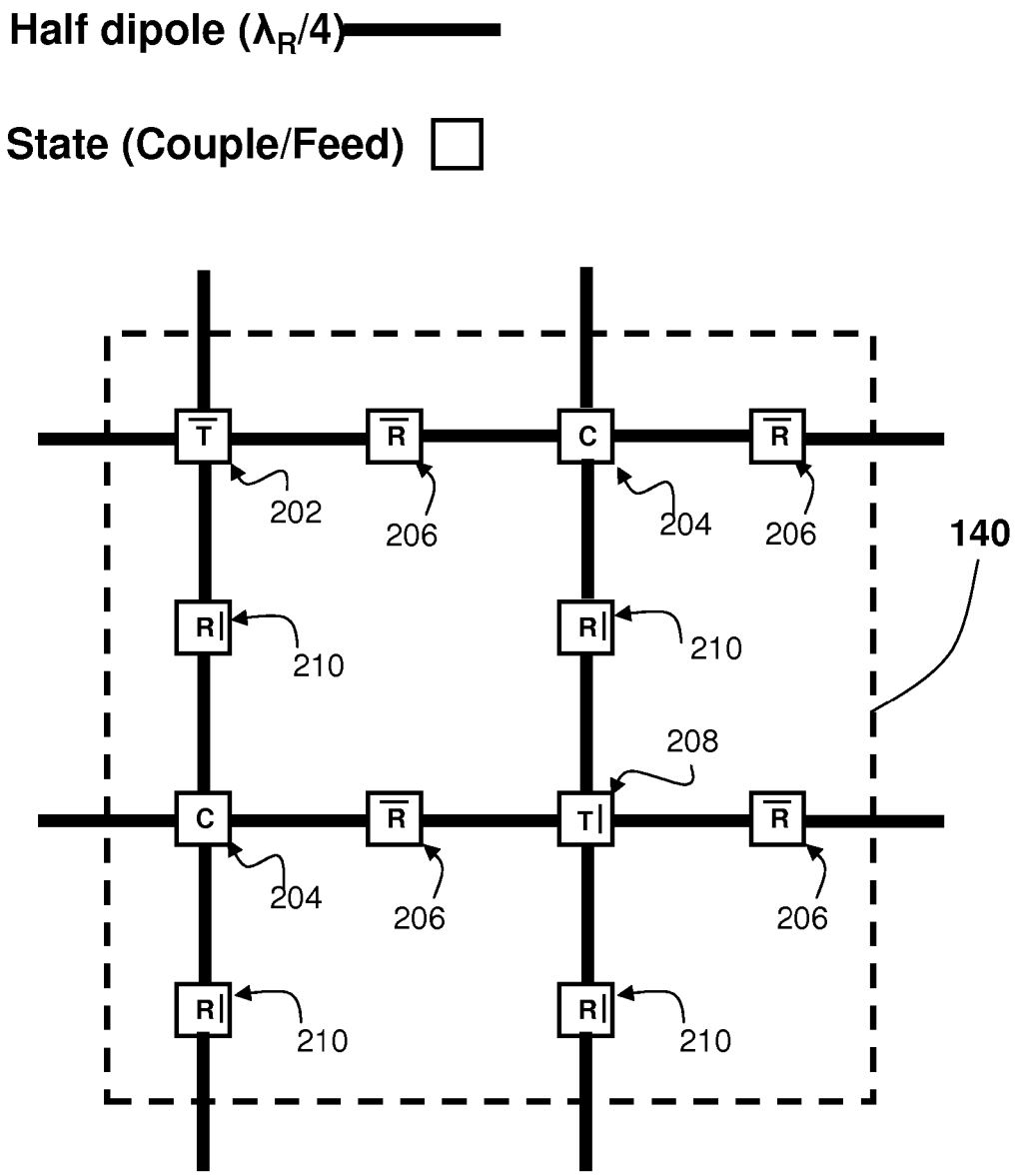
FIG. 21 is a unit cell for the multi-frequency array of FIG. 20.

In many systems it may not be necessary for the transmit function to cover the same bandwidth as for the receive function. In this case a solution involves the number of transmit ports being half or less than the number of receive ports. FIG. 20 depicts a case in which the receive bandwidth is twice that of the transmit bandwidth. Also shown in FIG. 20 is a unit cell of the area, delineated by the dotted box 140. The unit cell is a structure which can be repeated in both directions to fill the array. An expanded view of the unit cell is shown in FIG. 21.

Referring back to FIG. 20, how one can distribute the transmit and receive element couplings to the array is now described. In FIG. 20 there is a horizontal line 200, shown connecting several feeds for the horizontal (X) feed elements. Also in line 200 and as shown in the lower part of the FIG. 20, as well as in FIG. 21, are transmit elements 202 for the horizontal orientation, crossover elements 204 containing only coupling connections, and receive elements 206 for the horizontal direction. On the other hand, in the vertical direction there are state switches and receive elements 210 for the vertical direction coupled to them. Also inside the unit cell is a transmit element 208 for the vertical direction. The lines inside the square T or R boxes refer to a connection across opposed dipole ends in the directions illustrated.

As seen in FIG. 20, arrays can be manufactured with different available bandwidths for the transmit and receive functions. In this case one can see that there are a number of receive elements inside the dotted unit cell 140, noting that there are four times as many receive elements as transmit elements. This corresponds to the receive spacing being one half as great as the transmit spacing. Thus, a phased receive array can operate at twice the frequency range of a phased transmit array.

The above has to do with the repeat size of the antenna. Inside the unit box would be for instance two of the receive repeats as opposed to the one for the transmit mode in each direction.

Figure 22:
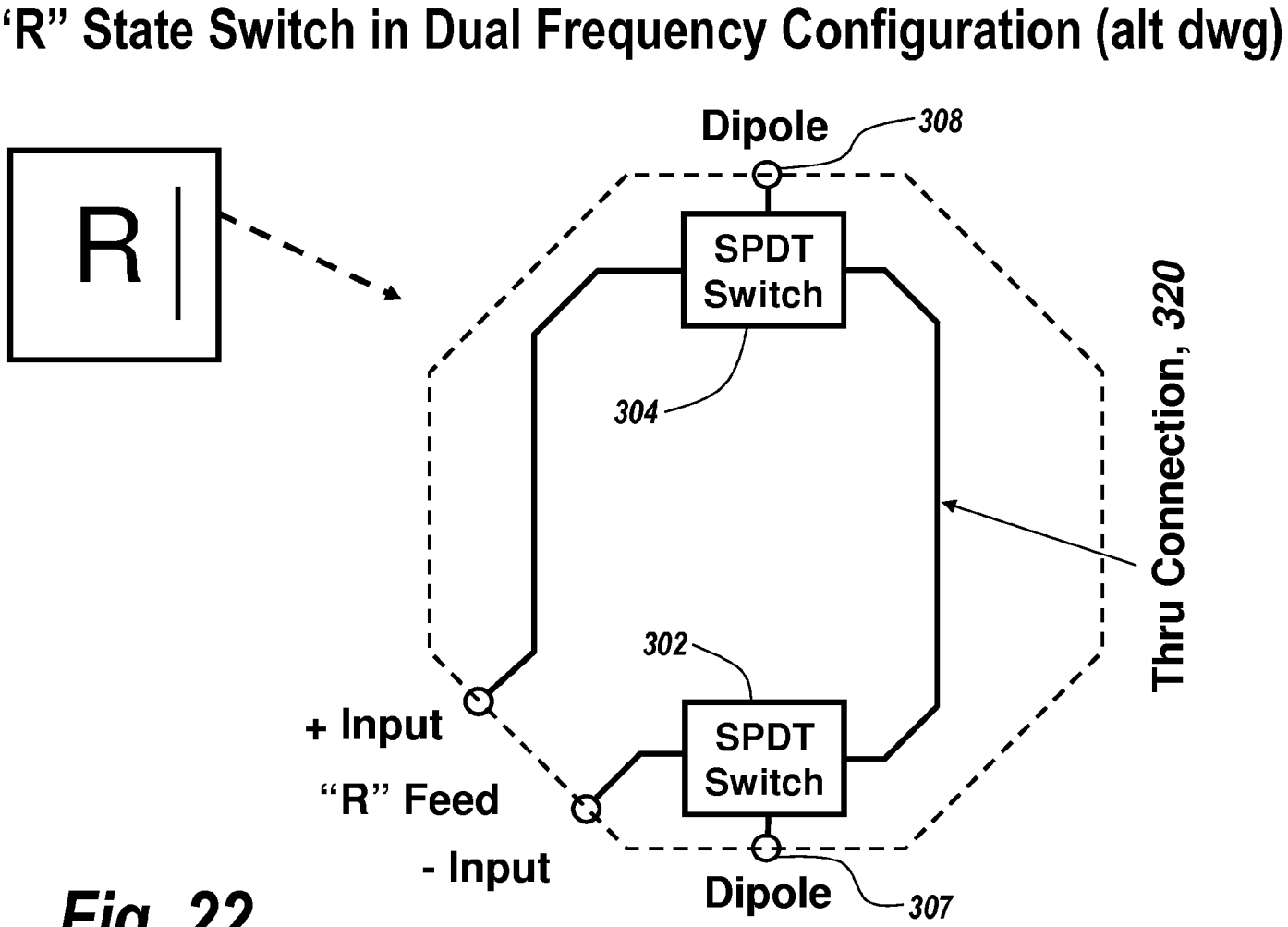
FIG. 22 is a schematic diagram of a modified state switch for use in the receive feed in dual frequency arrays; and, FIG. 23 is a schematic diagram of three equivalent configurations of the quad-connected coupling connection of FIG. 15.
Figure 23:
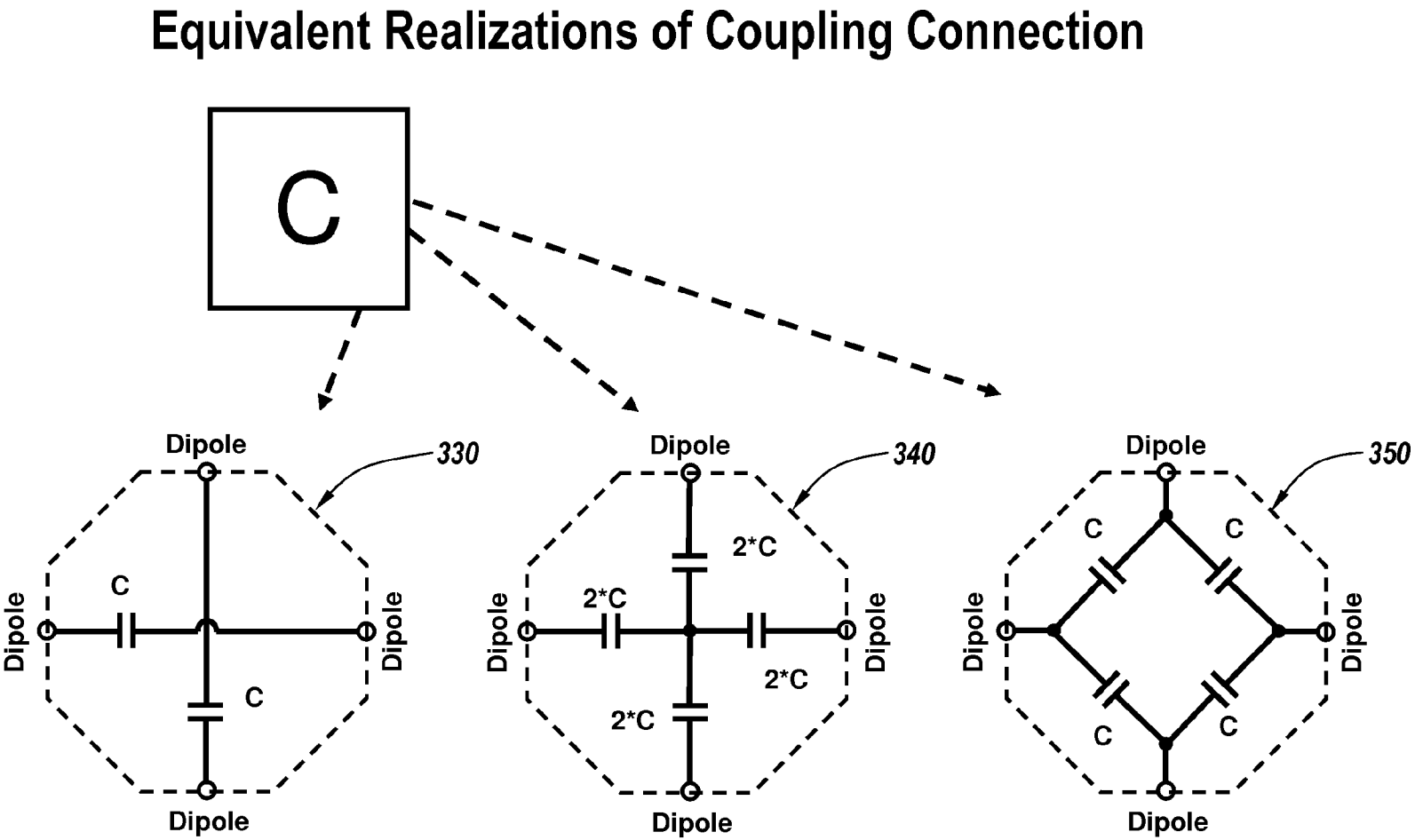

The schematic for the state switch configuration of the transmit connection in this case is the same as in FIG. 19. Here the corresponding state switch for the receive connection is shown in FIG. 22 in which SPDT switches 302 and 304 coupled to the "R" feed input and dipole ends 307 and 308. Note that there is no coupling connection, but rather a straight through connection for the transmit state such that dipole end 307 is directly coupled to dipole end 308 utilizing a through connection 320. This connects the segments of the longer dipole required for transmit operation. The quad coupling connection is the same as in FIG. 15, and FIG. 23 shows three equivalent representations 330, 340 and 350.

Referring back to FIG. 20, if one goes across on line 200, one sees two receive feeds which are spaced $\lambda_R/2$ in width and a transmit feed spacing which is $\lambda_T/2$ in width, that is twice as long as $\lambda_R/2$ What this width represents is a box where $\lambda_R/2$ represents the highest frequency of the receive dipole of the phased array. Since the transmit portion operates at an effective bandwidth of (2) $\lambda/2$ it corresponds to half the bandwidth of the receive array. What will be appreciated is that the effective $\lambda/2$ bandwidth for the receive array is one half the $\lambda/2$ bandwidth for the transmit array, such that there are four times as many receive elements in a given unit box than transmit elements. Thus, one can listen for twice the frequency bandwidth as compared to that associated with the transmit array.

Moreover, as can be seen from FIGS. 20 and 21 the receive mode requires no terminations in cross polarization positions. As illustrated a unit cell (based on the transmit function) is shown with a dashed box 140. Note that other array combinations are possible, such as dual band receive or dual band transmit.

All of the above configurations share a common feature. All of the port connections are balanced. By using differential transmit and receive amplifiers directly connected to the antenna feed or interface, baluns and other performance restricting components can be eliminated. Such amplifiers have been used in both receive and transmit programs, and can leverage an approach described in D. Meharry, "Wideband Differential Amplifier Including Single-ended Amplifiers Coupled to a Four-port Transformer," U.S. patent application Ser. No. 12/564,791, filed Sep. 22, 2009, the contents of which are incorporated herein by reference.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for elimination of duplexers in transmit/receive phased array antennas, comprising the steps of:

providing a receive element and a transmit element;

providing a number of dipoles, each having a feedpoint and dipole ends; and, providing state switches between adjacent dipole ends and at dipole feedpoints, a state switch alternately connecting a coupling element between adjacent dipole ends or dipole feedpoints and providing direct connection to either the receive element or the transmit element, such that the array may be converted from a transmit mode to a receive mode or from a receive mode to a transmit mode by controlling the state of the state switches.

2. The method of claim 1, and further including a transmit element coupled to one state switch and a receive element coupled to an adjacent state switch.

3. The method of claim 2, and further including the step of controlling the state of a state switch and the on and off state of a receive element and the on/off state of a transmit element, with the controlling step transforming the array from a transmit mode to a receive mode or from a receive mode to a transmit mode.

4. The method of claim 1, wherein the array includes a linear array of dipoles.

5. The method of claim 4, wherein the array further includes an orthogonal array of dipoles.

6. The method of claim 5, wherein the orthogonal array of dipoles cross the linear array of dipole at least one cross point.

7. The method of claim 6, and further including the step of providing the cross point with coupling elements between opposed ends of adjacent dipoles.

8. The method of claim 5, and further assigning state switches to various nodes of the array such that for one condition of the state switch the bandwidth of the array is twice that associated with the other condition of the state switch.

9. The method of claim 5, wherein the linear and the orthogonal arrays constitute an XY array and further including the step of coupling receive elements and transmit elements to selected state switches to effectuate polarization control of the array.

10. The method of claim 1, wherein the state switch is provided with a pair of single-pole double-throw switches and a coupling element therebetween, the state switch including an input/output node that is switchable by the state switch directly across adjacent dipole elements in one state and that is switchable to interrupt the direct connection in the alternate state and for connecting the coupling element across the adjacent dipole elements.

11. A tightly coupled phased array comprising:

a number of dipoles each having quarter wave dipole elements with each dipole element having opposed ends;

state switches coupled across selected dipole element ends, said state switches having balanced input/output ports, said state switches switching said input/output ports directly to the opposed dipole element ends or connecting a coupling element across said dipole element ends;

a number of transmit and receive elements coupled to different state switches and activated to be in an on state or an off state; and, a control unit operably connected to said state switches and said transmit and receive elements to control the transmit and receive state of said array, whereby said array is capable of said transmit and receive function without the use of duplexers.

12. The array of claim 11, wherein said state switches are of a size that fits at least partially between said opposed dipole element ends.

13. The array of claim 11, wherein said array includes orthogonal linear dipole arrays, said linear dipole arrays crossing each other at a cross point, the dipoles in each of said linear dipole arrays having opposed dipole element ends that form the feed of the associated dipole, opposed non-feed dipole element ends of adjacent dipoles being provided with state switches for switching a coupling element between said adjacent ends, the adjacent dipole element ends at a cross point having state switches associated therewith configured to switch said coupling elements between opposed dipole ends, whereby no RF leads are required at said dipole ends at said cross point, thereby to reduce the complexity of said array.

14. The array of claim 11, wherein the size of said state switch is such that the major portion of said state switch fits between opposed dipole element ends.

15. A tightly coupled dipole array coupling a first set of dipoles aligned in one direction and a second set of dipoles aligned in an orthogonal direction to form an orthogonal matrix of dipoles, each of said dipoles having a feedpoint and a pair of dipole element ends;

a number of transmit and receive elements; and, a number of state switches coupled across said feedpoints and adjacent dipole element ends, said state switches including circuitry for connecting the input/output terminal thereof directly across a dipole feedpoint or connecting a coupling element therefore across, whereby the array of state switches permits configuring of said array to be either a transmit array or a receive array depending on the state of said state switches and the states of the transmit and receive elements associated with said state switches.

16. The array of claim 15, and further including a control unit coupled to said state switches for controlling the state of the state switches.

17. The array of claim 16, wherein said transmit and receive elements are associated with different ones of said state switches such that adjacent state switches have an assigned receive element and an assigned transmit element, whereby no transmit and receive element are connected to the same state switch.

18. The array of claim 17, wherein said state switches include a pair of single-pole double-throw switches.

19. The array of claim 18, wherein a pair of said single-pole double-throw switches has a coupling element coupled therebetween.

* * * * *